US005191989A

United States Patent [19]

Butler

[11] Patent Number: 5,191,989

[45] Date of Patent: Mar. 9, 1993

[54] SYSTEM FOR CONSTRUCTING STORAGE CONTAINERS FOR READY ASSEMBLY AND DISASSEMBLY

[76] Inventor: Bruce J. Butler, 5 Gladney Street, St. John's, Newfoundland, A1E 4T7, Canada

[21] Appl. No.: 839,304

[22] Filed: Feb. 20, 1992

[51] Int. Cl.[5] ..... B65D 6/24

[52] U.S. Cl. ..... 220/4.34; 220/4.33

[58] Field of Search ..... 220/4.33, 4.34, 4.28, 220/4.31, 4.32

[56] References Cited

U.S. PATENT DOCUMENTS

| | | | |
|---|---|---|---|
| 2,521,279 | 9/1950 | Becker | 220/4.34 |
| 3,302,874 | 2/1967 | Dohner | 220/4.34 |
| 4,231,203 | 11/1980 | Mikkelsen et al. | 220/4.34 |
| 4,300,695 | 11/1981 | Hsu | 220/4.34 |
| 4,711,361 | 12/1987 | Mischenko | 220/4.34 |
| 4,789,075 | 12/1988 | Sun | 220/4.34 |

FOREIGN PATENT DOCUMENTS

| | | | |
|---|---|---|---|
| 1339521 | 12/1973 | United Kingdom | 220/4.34 |

*Primary Examiner*—Joseph Man-Fu Moy

*Attorney, Agent, or Firm*—Christie, Parker & Hale

[57] ABSTRACT

There is provided a new and useful component system for constructing storage containers adapted for ready assembly and disassembly, the system comprising a series of panels at least some of which include tongues or grooves along at least two edges thereof; each tongued panel comprising a sheet section having an edge flange therearound, and at least one tongue disposed longitudinally of and extending outwardly from at least two associated edges; each grooved panel comprising a sheet section having an edge flange therearound and having associated with at least two edges thereof and spaced from the edges a receiving channel, the channel including at least one opening through the sheet section; and wherein each tongue of a tongued panel is adapted for insertion through a corresponding opening of an adjacent grooved panel into an associated receiving channel; the system further comprising at least one locking member slidable in each receiving channel and for slidably engaging and locking each tongue in position when the tongue is inserted through a corresponding opening into an associated receiving channel.

12 Claims, 10 Drawing Sheets

92
94
40
90
30
46
44
46
42
88

92
44
90
44
90
44
86
88

38
14,16
36
28
42
44
46
90
28
90
28

38
86
92
94
88

28
86
40
38
36
28

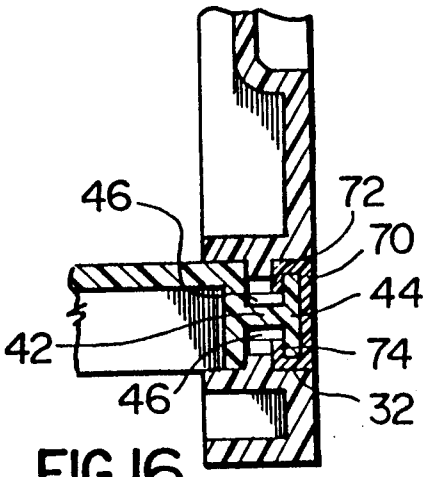
FIG.16
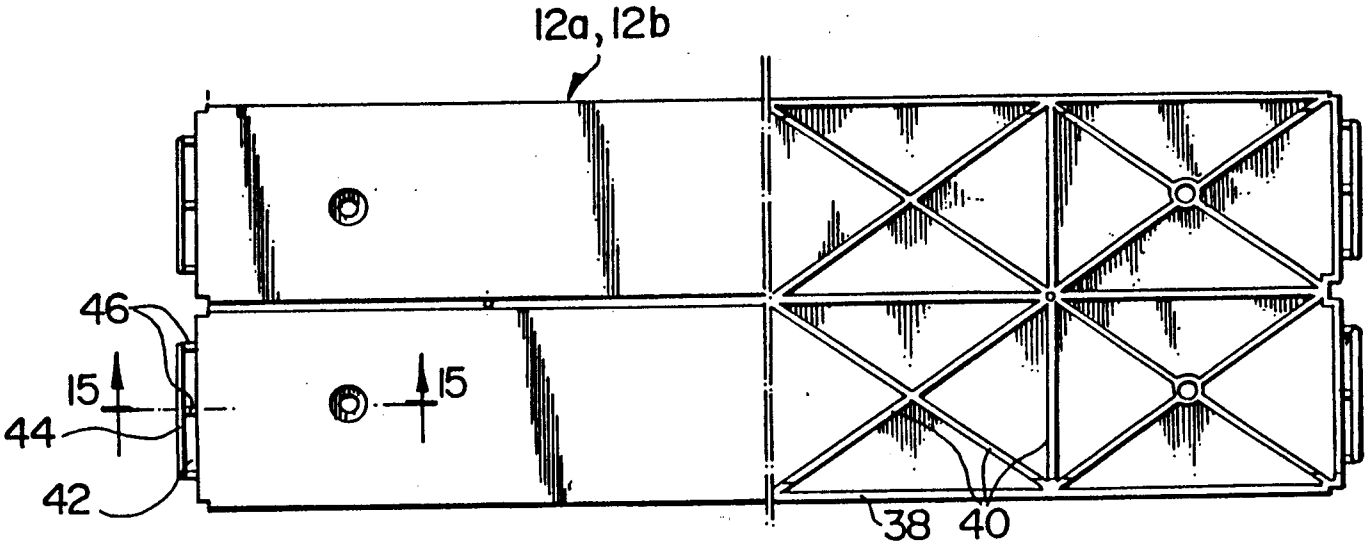
FIG.14
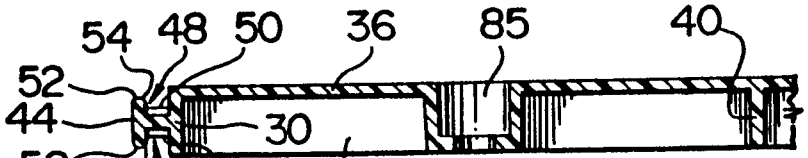
FIG.15
FIG.13

SYSTEM FOR CONSTRUCTING STORAGE CONTAINERS FOR READY ASSEMBLY AND DISASSEMBLY

FIELD OF THE INVENTION

This application relates to a component system for constructing storage containers adapted for ready assembly and disassembly and to storage containers constructed using the system.

BACKGROUND OF THE INVENTION

There is an ongoing need both in the residential and commercial context for a range of small or medium-sized containers which can be readily assembled and disassembled.

Typical requirements in the residential context which are not currently being adequately met include, for example, storage boxes for larger toys, containers for garbage bags and storage containers for outdoor tools. This container size range falls below the range serviced by common metal garden sheds.

What containers have been available have tended to be expensive and to lack versatility and portability, and to be insufficiently rugged.

In the commercial context there are numerous requirements for small and medium-sized sturdy containers.

The usefulness of containers of the size of interest is greatly enhanced if the containers can be readily assembled and disassembled. This factor means, for example, that the container can be transported to the retailer, stocked and sold in a knockdown form requiring much less space and can readily be transported by a consumer in an automobile.

In the industrial context the knock-down feature offers the very significant advantage that the container, once emptied, can be disassembled prior to being shipped to a refilling point. The space and handling requirements are significantly decreased in this way.

Against this background the present invention provides a component system which can be readily assembled and formatted to form containers of various sizes and configurations. The containers are very stable when assembled but can be readily disassembled.

PRIOR ART

Applicant is unaware of any prior art which illustrates a similar system.

Of peripheral interest are Canadian Pat. Nos. 34,022, issued in 1890 to Nixon and relating to casket manufacture; 36,236, issued in 1891 to King and relating to a joint for use in furniture construction; 103,222, issued in 1907 to Amsden, relating to knockdown storage drawers; 105,535, issued in 1907 to Walton and relating to a system for constructing storage drawers; 924,371, issued Apr. 10, 1973, to Jedig and relating to knock-down kitchen cabinets; and 991,236, issued Jun. 15, 1976, to Ciancimino and relating to a manner of constructing furniture.

None of these references provides a system which is similar to that of the present case.

BRIEF SUMMARY OF THE INVENTION

It has now been found that a container of substantial strength and rigidity and which is readily assembled and disassembled can be constructed using a component system of interconnecting panels.

Thus, the invention provides a modular system for constructing storage containers adapted for ready assembly and disassembly, the system comprising a series of panels each of which includes tongues or grooves along at least two edges thereof; each tongued panel comprising a first sheet section having an edge flange therearound and at least one tongue disposed longitudinally of and extending outwardly from at least two associated edges; each grooved panel comprising a second sheet section having an edge flange therearound and having associated with at least two edges thereof and spaced from the edges a support and a receiving channel, the channels arranged in back to back configuration and interconnected by at least one opening through the sheet section; and wherein each tongue of a tongued panel is adapted for insertion through a corresponding opening of an adjacent grooved panel into an associated receiving channel, and each associated edge of a tongued panel is adapted for insertion into a corresponding support channel; the system further comprising at least one locking member slidable in each receiving channel and for slidably engaging and locking each tongue in position when the tongue is inserted through a corresponding opening into an associated receiving channel.

In a further embodiment the invention provides a modular system for constructing storage containers adapted for ready assembly and disassembly, the system comprising a series of panels each of which includes first and second congruent surfaces joined by corresponding edges, at least two edges of each panel having associated therewith integral joining means, the joining means comprising either (i) at least one tongue disposed longitudinally of and extending outwardly of at least one associated edge, or (ii) a receiving groove in the first surface spaced from the associated edge, an opening in the second surface communicating with the receiving groove; and wherein each tongue of one panel is adapted for insertion through a corresponding opening in an adjacent panel into an associated receiving groove; and at least one locking member slidable in each receiving groove for slidably engaging and locking each tongue in position when the tongue is inserted through a corresponding opening into an associated receiving groove.

BRIEF DESCRIPTION OF THE DRAWINGS

In drawings which illustrate embodiments of the invention,

FIG. 13 is a top view of a floor panel of the embodiment of FIG. 1;

FIG. 14 is a bottom view of the panel of FIG. 13;

FIG. 15 is a transverse section through the panel of FIG. 13;

FIG. 16 is a section through a joint for use in the invention;

Figure 1:
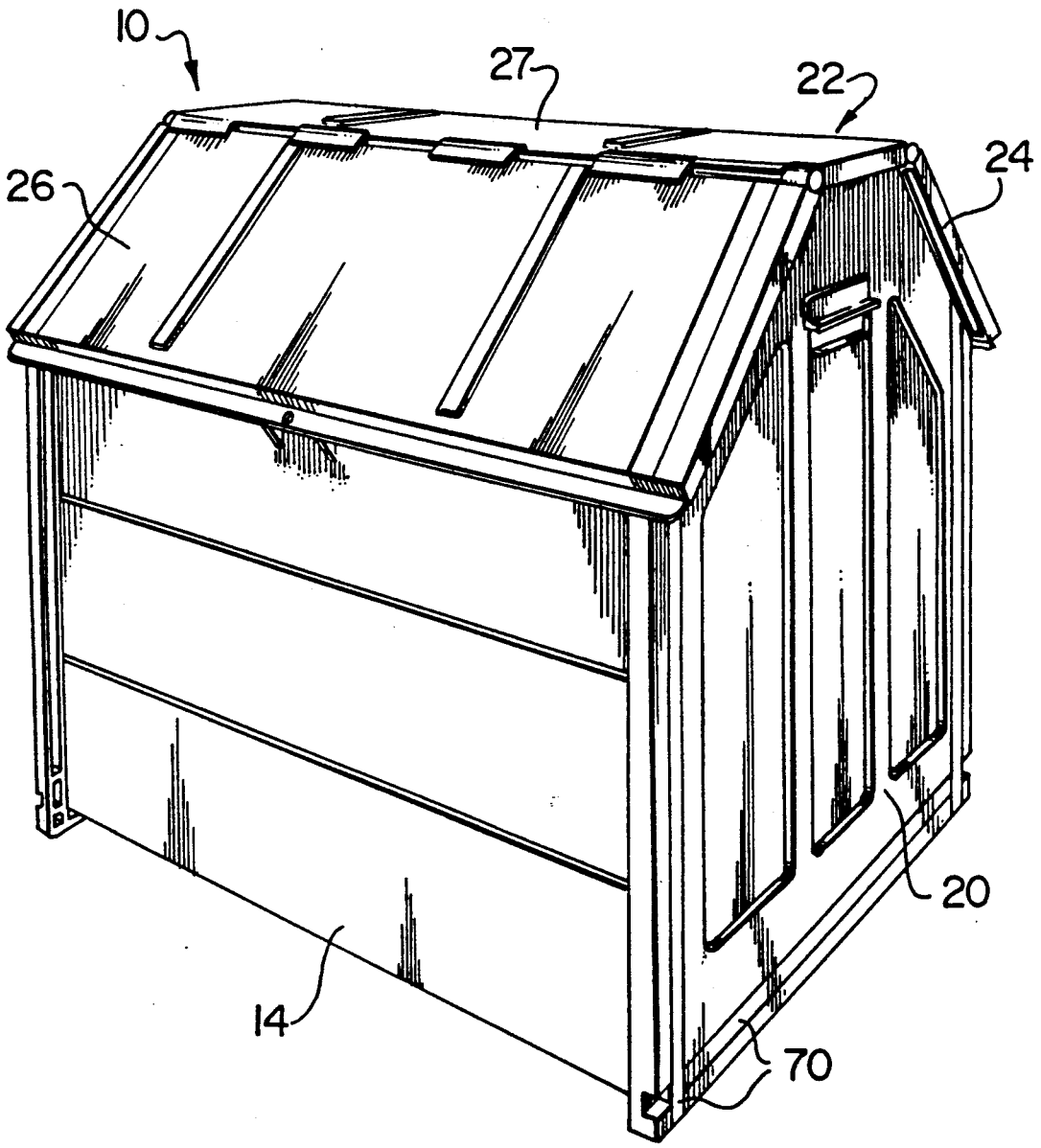
FIG. 1 is a perspective view of a container in accordance with the invention.

While the invention will be described in conjunction with illustrated embodiments, it will be understood that it is not intended to limit the invention to such embodiments. On the contrary, it is intended to cover alternatives, modifications and equivalents as may be included within the spirit and scope of the invention as defined by the appended claims.

DETAILED DESCRIPTION OF THE PREFERRED EMBODIMENTS

In the following description, similar features in the drawings have been given similar reference numerals.

While it will be evident that many configurations of the invention can be assembled for specific purposes, the invention will be described in detail in terms of the typical structure illustrated in the drawings. That structure might be used, for example, as a domestic garbage bag receptacle, a box for storage of large toys, or for numerous other uses.

With reference to the drawings the container 10 comprises bottom panel 12, front and back panels 14 and 16, side panels 18 and 20, and top 22. Top 22 comprises a fixed panel 24 and a pair of hinged panels 26 and 27.

While the container 10 will now be described in detail with reference to panels in accordance with the invention, it should be noted that all panels forming the container are not necessarily in accordance with claimed embodiments. For example, the bottom panel 12 may lend itself to various treatments which do not utilize the preferred joint configuration to be described.

Other such arrangements may be utilized in association with the basic panels, depending on the particular use configuration.

Figure 2:
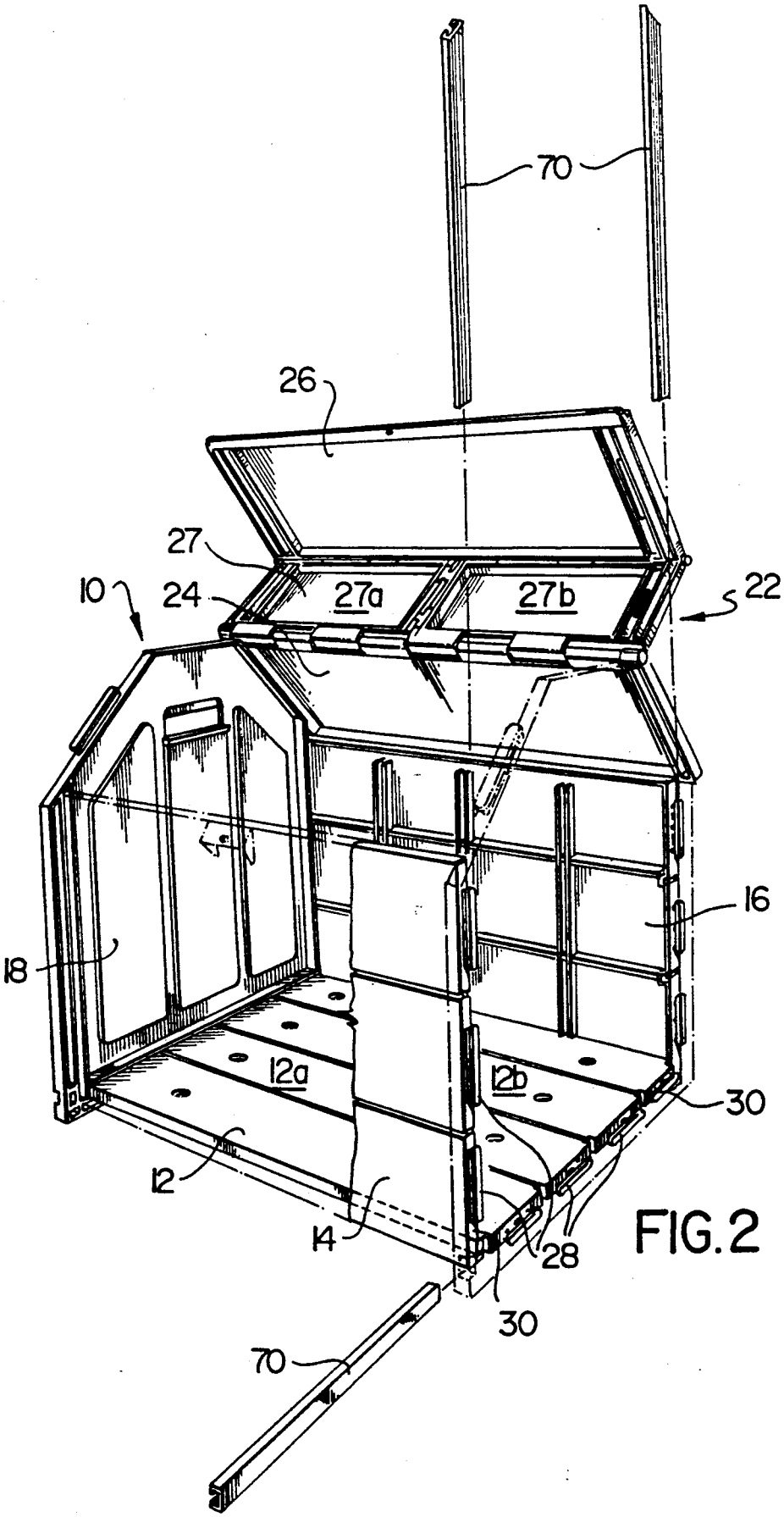
FIG. 2 is an exploded perspective view of a container according to the invention.
Figure 3:
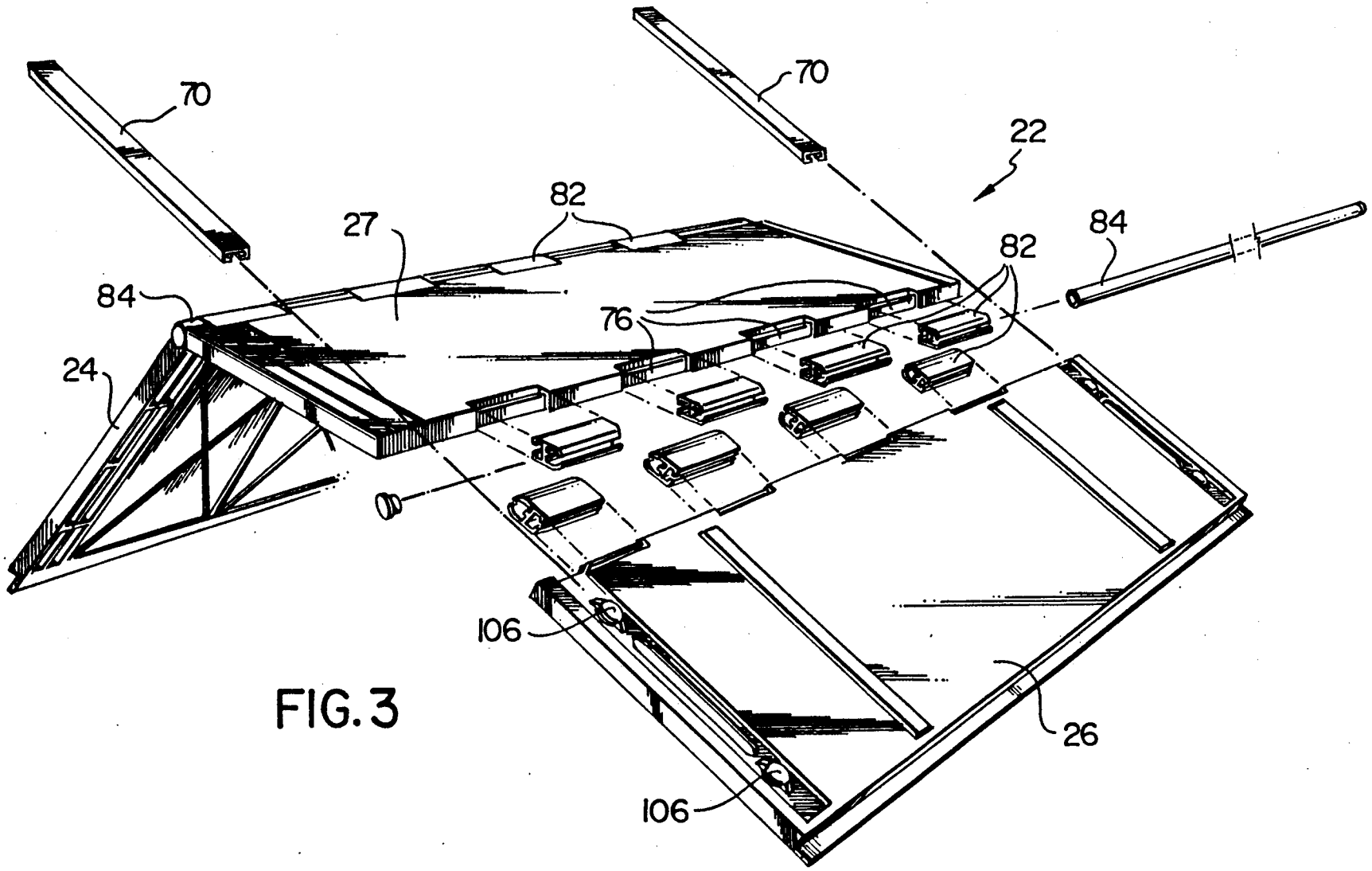
FIG. 3 is an exploded perspective view of one embodiment of a lid structure for use in the present invention.
Figures 4, 5, 6, 7, 8, 9:
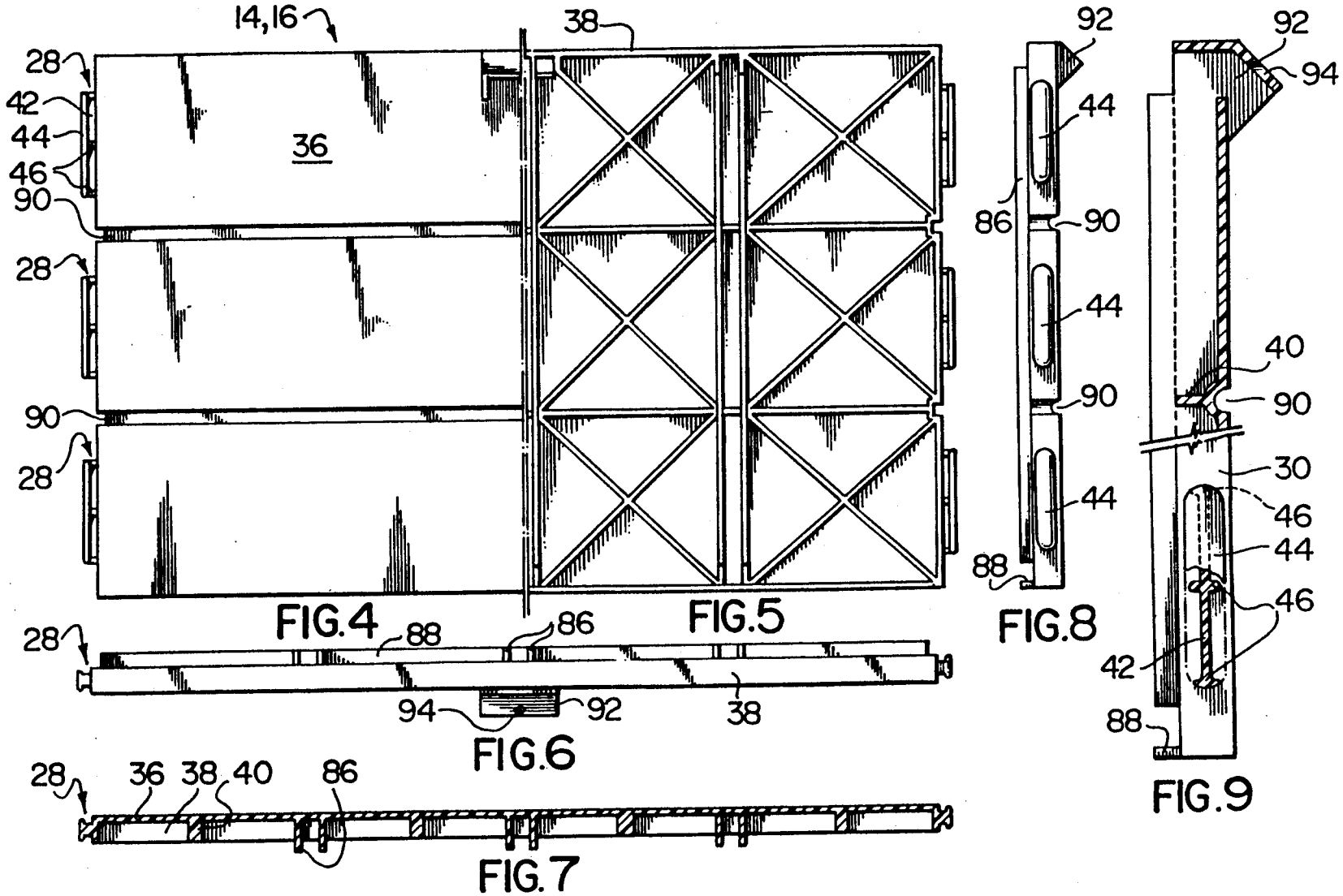
FIG. 4 is a front elevation of part of a front or back panel of the embodiment of FIG. 1.
FIG. 5 is a rear elevation of part of a panel of FIG. 4.
FIG. 6 is a top plan view of a panel of FIG. 4.
FIG. 7 is an end view of a panel of FIG. 4.
FIG. 8 is a transverse section through a panel of FIG. 4.
FIG. 9 is a partial vertical section partial cutaway section through a panel of FIG. 4.

FIG. 2 illustrates the manner in which containers of different sizes may be built up. Utilizing panels of any desirable size but of the configuration of panels 12, 14, 16, 18, 20, 24, 26 and 27, different sized structures can be produced by simply extending the length of locking members 70 and adding more panels.

Each of the panels according to the invention is provided with joining means for joining a panel to one or more adjacent panels. Each panel according to the invention will have joining means associated with at least two of its edges.

For some of the panels the joining means will comprise at least one tongue 28. As illustrated in FIG. 2, the front and back panels 14 and 16 each include three said tongues on each of two edges. In each case the tongue 28 is disposed longitudinally of an associated edge 30 and extends outwardly of the edge.

Others of the panels will include a receiving groove 32 (see especially FIGS. 10 to 12) associated with but spaced from an associated edge 34.

When the panels are assembled to form a container the tongues 28 of one panel will be received into the receiving grooves 32 of adjacent panels.

In the illustrated embodiments each panel is preferably constructed having a surface 36 and depending edge flanges 38. In the preferred embodiment, a series of reinforcing ribs 40 are formed beneath surface 36 and between flanges 38.

Each tongue 28 comprises a thin web section 42 depending outwardly from the associated edge 30. Web section 42 is capped by a wider outer section 44. A series of transverse reinforcing webs 46 extend between associated edge 30 and outer section 44. That part 48 of the outer section 44 of tongue 28 which lies between the outer edges 50 (see FIG. 15) of reinforcing webs 46, and outer edges 52 of outer section 44 of tongue 28 comprise a pair of locking flanges 54 and 56.

Figure 11:
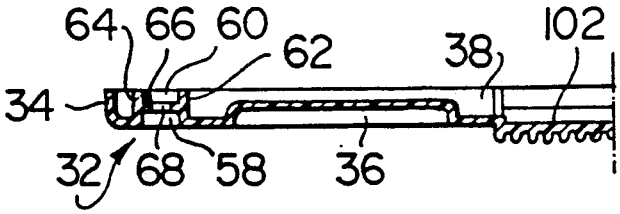
FIG. 11 is a transverse section through the panel of FIG. 10.
Figure 10:
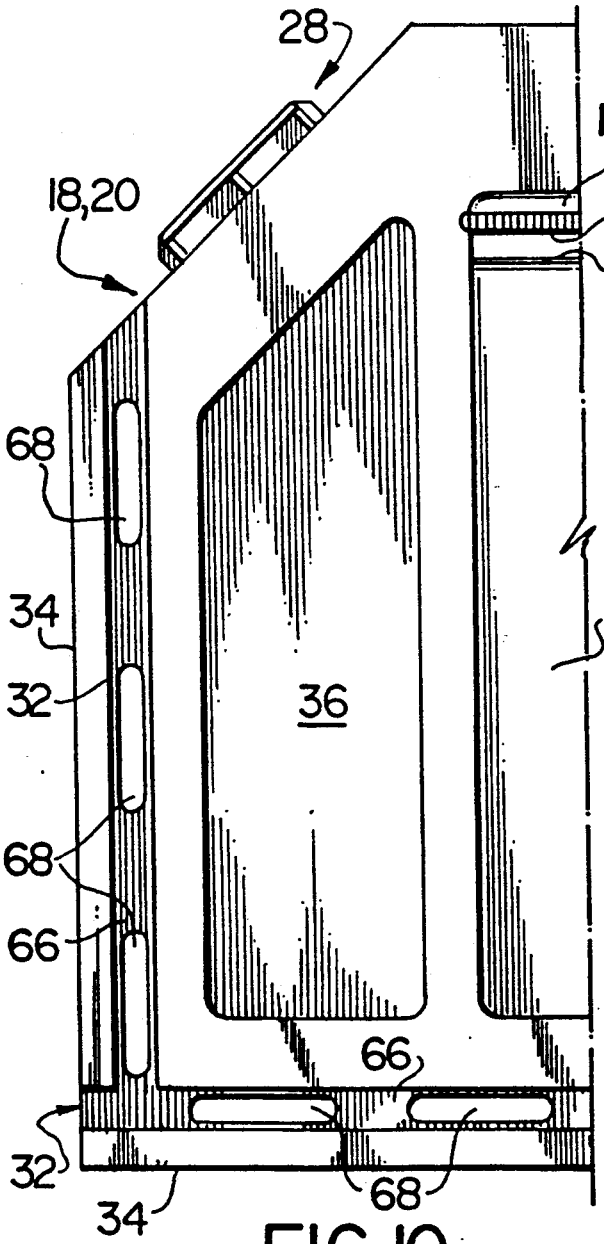
FIG. 10 shows detail of an end panel of the embodiment of FIG. 1.
Figure 12:
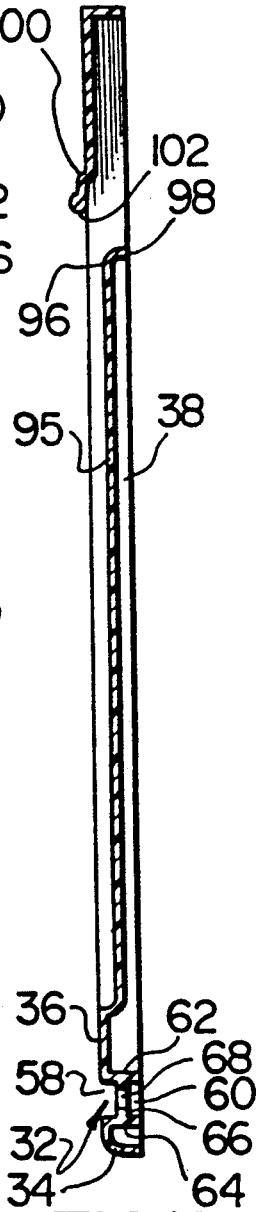
FIG. 12 is a vertical section through the panel of FIG. 10.

The receiving groove 32, as best illustrated in FIGS. 10 to 12, comprises a pair of channels 58 and 60 defined by ribs 62 and 64 and transverse web 66. Transverse web 66 will include at least one opening 68 to permit insertion of a tongue 28 of an adjacent panel into the receiving groove 32 during assembly of a container. The number and positioning of openings 68 of a first panel will thus obviously correspond to the number and positioning of tongues 28 of a second panel to which the first panel is to be connected.

A locking strip 70 is provided for locking tongues 28 in position in receiving grooves 32. The locking strip 70 is a channel shaped member having exterior dimensions just less than those of channels 58 so that locking strip 70 can be slidably received in channels 58. Locking strip 70 includes a pair of locking flanges 72 and 74. In assembling a pair of panels; for example, bottom panel 12 and a side panel 18, the tongues 28 of bottom panel 12 are inserted through corresponding openings 68 into receiving groove 32 of side panel 18. The locking strip 70 is then slid into groove 32 of side panel 18 with the locking flanges 72 and 74 of locking strip 70 engaging under the locking flanges 54 and 56 respectively of tongues 28. The tongues 28 are thus secured within the grooves 32 and are well supported by the substantial areas of contact surfaces around the joint.

Figure 19:
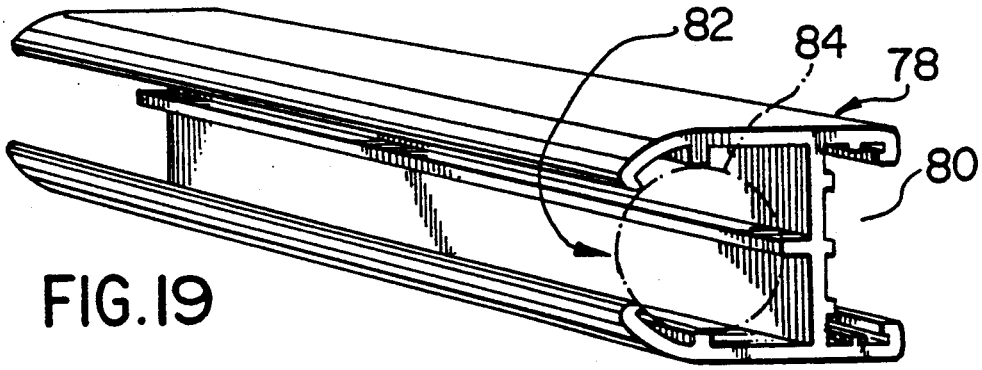
FIG. 19 is a perspective of a hinge channel for use in the invention.
Figure 17:
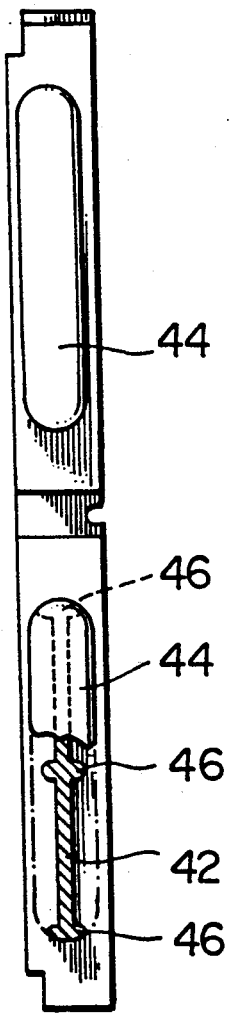
FIG. 17 is an end view partially cut away of the panel of FIG. 13.
Figure 18:
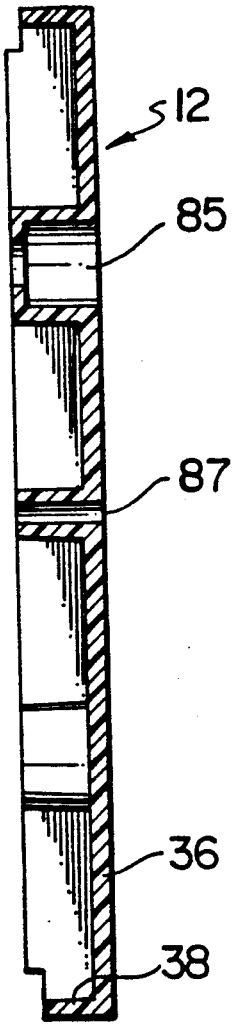
FIG. 18 is another vertical section through the panel of FIG. 13.
Figure 20:
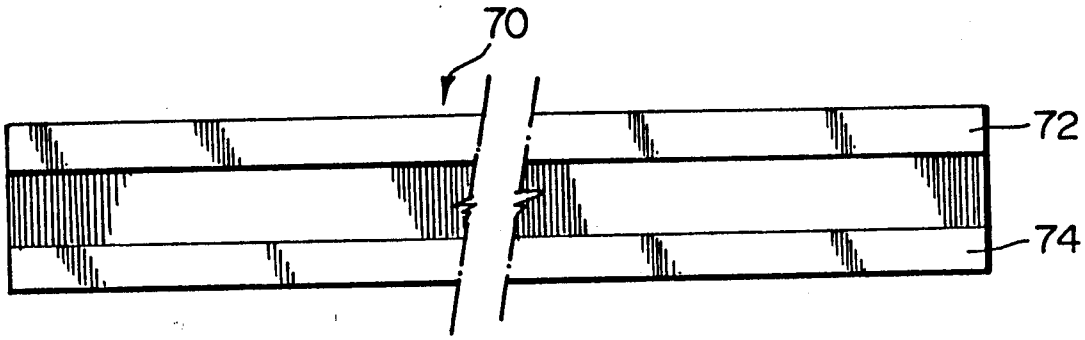
FIG. 20 illustrates a locking strip for use in the joints in the invention.
Figure 21:
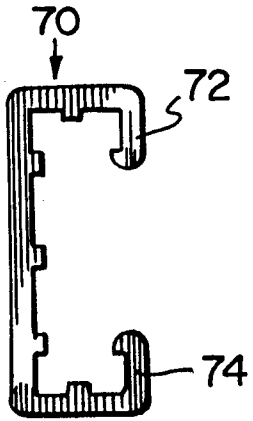
FIG. 21 is a section through the locking strip of FIG. 20.

In order to provide easy access in a preferred embodiment of the container constructed according to the inventive system, a double-hinged top 22 is preferably provided in which a panel 26 is hingedly connected to a second panel 27 which is in turn hingedly connected to a fixed panel 24. In one preferred hinge construction the corresponding edges of two panels which are to be hinged to each other are provided with generally T-shaped discontinuous tongues 76. Co-operating channel members 78 (FIG. 19) are then provided including a T-shaped groove 80 corresponding in configuration to the T-shaped tongue 76 and which may preferably be snap-fitted over tongue 76. Channel members 78 also include second channel sections 82 which are shaped to receive a hinge pin 84. The tongues 76 and thus the channel members 78 are arranged in alternating configuration with those of a second panel to which the first panel is to be hingedly connected. When the two panels are to be connected, the respective channel sections 82 are interfitted and a hinge pin 84 inserted.

Various preferred features of the invention pertain to each of the panels 12, 14 and 16, 18 and 20, 24, and 26 and 27.

In the preferred configuration the bottom panel 12 is in fact divided into two panels of equal width. These panels may be provided with anchoring bores 85 for anchoring the box to a surface where desired, and with drain openings 87.

The back and front panels 14 and 16 are provided with extended reinforcing ribs 86 and extended plate 88 from bottom flange 38 for extra reinforcing. Decorative and reinforcing grooves 90 are also preferably provided.

Finally in terms of the front and back panels 14 and 16, these preferably include an upper flange 92 including a bore 94. The flange 92 will provide extra support for the top panels 24 and 26 and in the case of fixed panel 24 will provide through bore 94 a position to which panel 24 may be secured by mans of a screw or the like, if desired, for extra rigidity.

As illustrated in the sectional views in FIGS. 11 and 12, a handle arrangement is provided on the side panels 18 and 20 to enable the structure to be readily lifted and moved when in the assembled condition. Thus, a recessed section 95 of the surface 36 curves inward at 96 to terminate at 98 on the interior side of the panel. At the same time a corresponding upper section 100 of surface 36 terminates at 102 upwardly of the inward curve 96 of the section 95 of surface 36.

As well, the part of upper section 100 around the end 102 is formed to provide a comfortable hand hold.

Thus, it can be seen that a handle is formed in which the end 102 of section 100 of surface 36 forms the handgrip while the space between the end 102 and the inward curve 96 allows the hand to be inserted to effect the grip.

The top 22 of the container in the preferred configuration includes a number of additional features. For rigidity the panels preferably include raised ridges 104.

Figures 22, 23, 24, 25, 26:
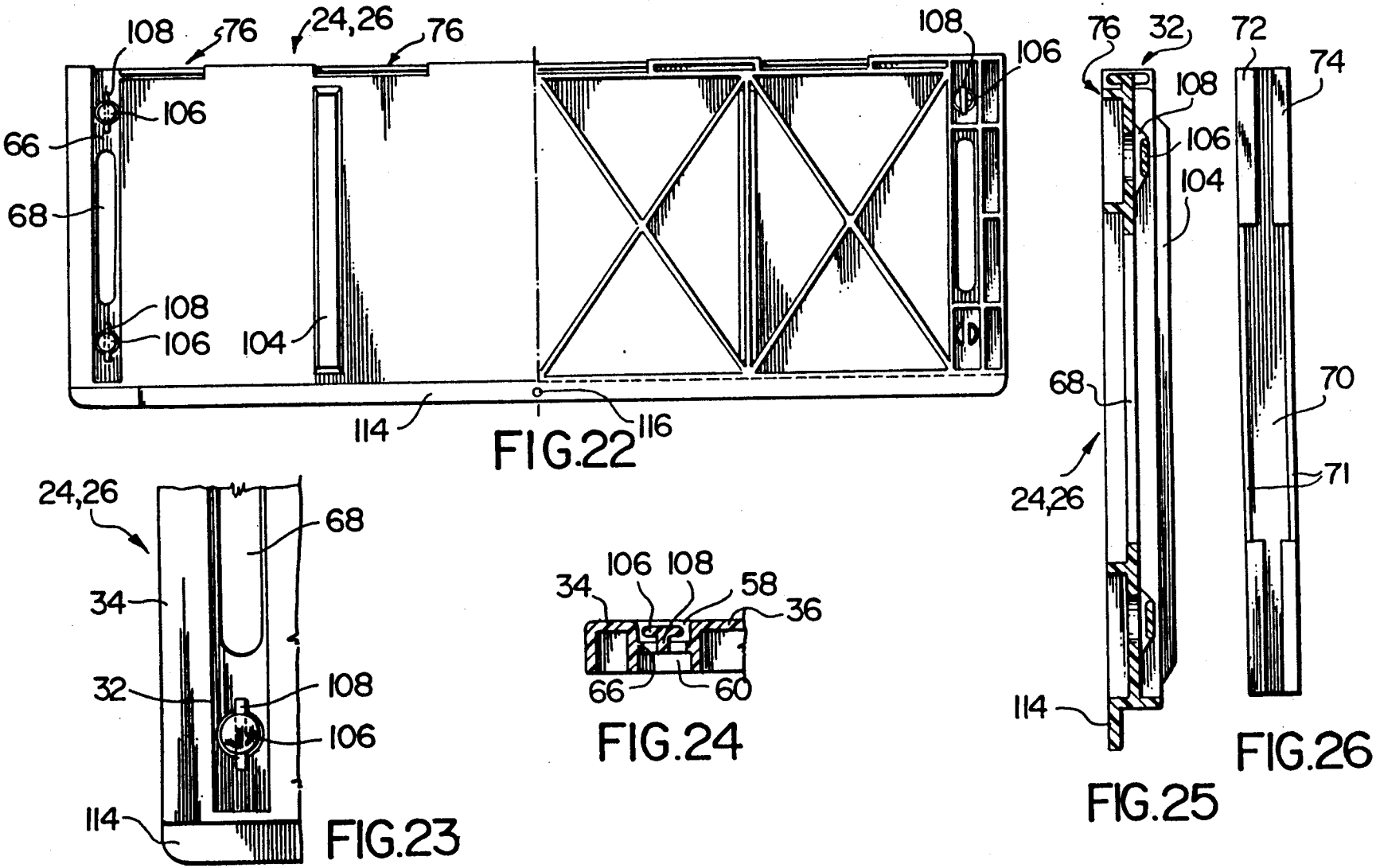
FIG. 22 is a top view partially cut away of an outer lid panel of the embodiment of FIG. 1.
FIG. 23 illustrates detail of a part of the panel of FIG. 22.
FIG. 24 is a section through a part of the panel of FIG. 22.
FIG. 25 is a section through a part of the panel of FIG. 22.
FIG. 26 is a form of locking strip for use in the panel of FIG. 22.
Figure 28:
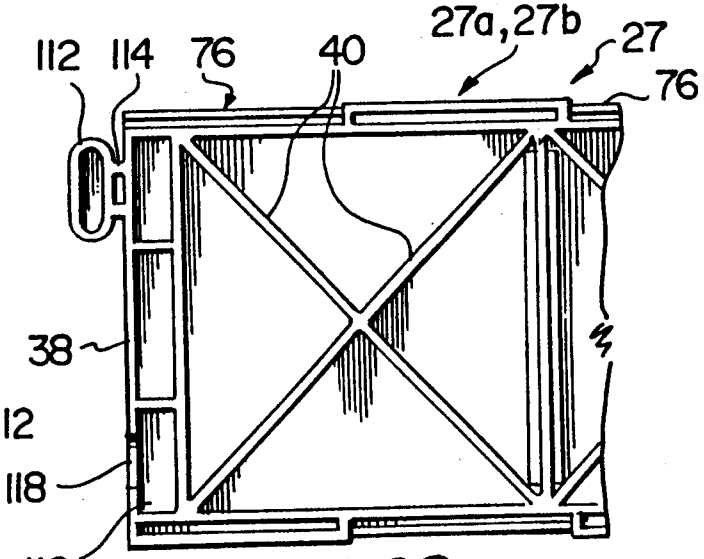
FIG. 28 is a partial bottom view of a top centre panel of the embodiment of FIG. 1.
Figure 30:
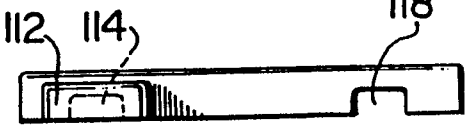
FIG. 30 is a side edge view of the panel of FIG. 27.
Figure 27:
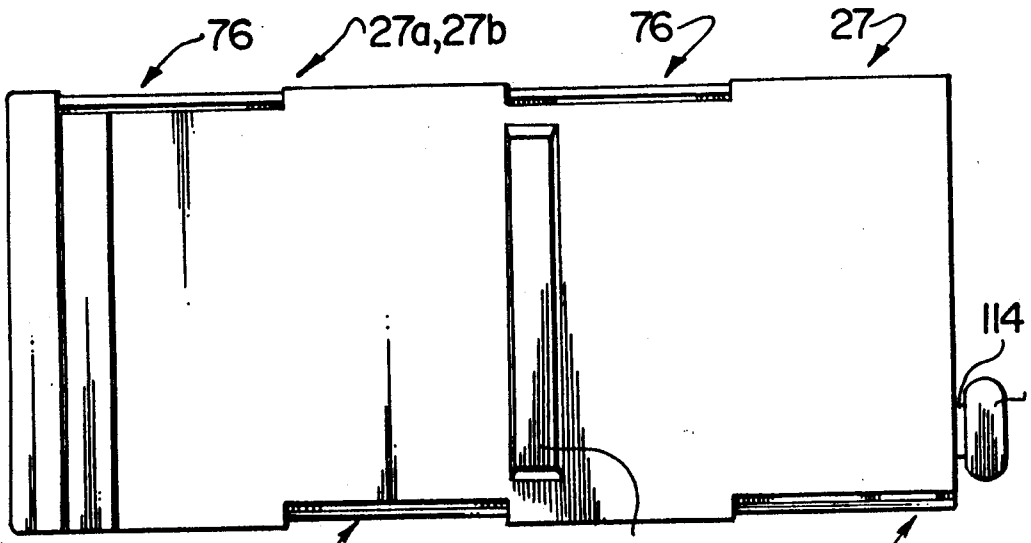
FIG. 27 is a top view of one section of a top centre panel of the embodiment of FIG. 1.
Figure 29:
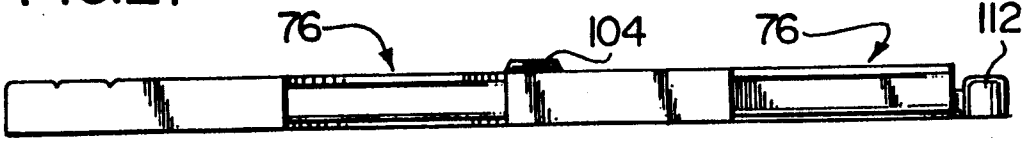
FIG. 29 is a front edge view of the panel of FIG. 27.

Since fixed panel 24 and hinged panel 26 are preferably identical, and since only fixed panel 24 will receive tongues 28 in receiving grooves 30, the arrangement of FIGS. 23 and 25 is preferably provided to accommodate the locking strip 70 on panel 26. As well, since panel 24 receives only a single tongue 28, this arrangement provides additional stability for locking strip 70 in that case. A pair of discs 106 supported on webs 108 are provided on the transverse web 66. The underedge of discs 106 provides a flange to receive flanges 72 and 74 of locking strip 70.

FIG. 26 illustrates a special version of locking strip 70 for use with panel 26. That panel, when the top 22 of container 10 is closed, will receive tongues 28 from ends 18, 20, but not in a locking manner. In order to provide a uniform finished appearance, strip 70 of FIG. 26 will have an area 71 cut out of locking flanges 72 and 74. When the strip is applied to the panel 26 configuration shown in FIGS. 23 and 25, the strip will lock on discs 106 but will not lock a tongue received through opening 68.

As illustrated in FIG. 2, the panel 27 of top 22 is constructed in two parts **27*a* and 27*b*. The two parts are interconnected by the members 112. Members 112 are joined respectively to parts 27*a* and 27*b* by a narrow neck portion 114. Corresponding cavities 116 are defined in panels 27*a* and 27*b* for receiving the members 112. An indentation 118 receives the neck portion 14. The two sections 27*a* and 27*b*** can thus be snap fitted together.

This sectioning of panel 27 is entirely for economy of construction. This device allows for the pairing of all of the panels. Thus, bottom panel 12 is in fact preferably divided into two identical parts **12*a* and 12*b*, front and back panels 14 and 16 are identical, side panels 18 and 20 are identical, panels 24 and 26 of top 22 are identical, and now panels 27*a* and 27*b*** are identical. Thus, a single mould can be constructed to produce half the panels with a second run through the mould producing the other half. The most efficient use of the mould is thus accomplished.

What we claim as our invention:

1. A component system for constructing storage containers adapted for ready assembly and disassembly, said system comprising:

a series of panels, at least some of which include tongues or grooves along at least two edges thereof, each said tongued panel comprising a sheet section having an edge flange therearound, and at least one tongue disposed longitudinally of and extending outwardly from at least two associated said edges, each said grooved panel comprising a sheet section having an edge flange therearound and having a receiving channel associated with at least two edges thereof and spaced from said edges, said receiving channel comprising a recessed part of said sheet section, said channel including at least one opening through said sheet section, and wherein each said tongue of a tongued panel is adapted for insertion through a corresponding said opening of an adjacent grooved panel into an associated receiving channel, said system further comprising at least one locking member slidable in each said receiving channel and for slidably engaging and locking each said tongue in position when said tongue is inserted through a corresponding opening into an associated receiving channel.

2. A modular system for constructing storage containers adapted for ready assembly and disassembly, said system comprising:

a series of panels at least some of which include tongues or grooves along at least two edges thereof;

each said tongued panel comprising a sheet section having an edge flange therearound, and at least one tongue disposed longitudinally of and extending outwardly from at least two associated said edges;

each said grooved panel comprising a sheet section having an edge flange therearound and having associated with at least two edges thereof and spaced from said edges a support channel and a receiving channel, said channels arranged in back to back configuration and interconnected by at least one opening through said sheet section;

and wherein each said tongue of a tongued panel is adapted for insertion through a corresponding said opening of an adjacent grooved panel into an associated receiving channel, and each said associated edge of a tongued panel is adapted for insertion into a corresponding said support channel;

said system further comprising at least one locking member slidable in each said receiving channel and for slidably engaging and locking each said tongue in position when said tongue is inserted through a corresponding opening into an associated receiving channel.

3. The system of claim 1 wherein each said tongue includes a longitudinal locking flange on each side thereof and each said locking member includes a pair of longitudinal locking rails for sliding engagement with said locking grooves.

4. The system of claim 2 wherein each said tongue includes an outer section and said outer section has dimensions just less than corresponding dimensions of said opening whereby to fit closely through said opening.

5. The system of claim 3 wherein the width of said outer section of each said tongue is less than the thickness of said associated edge.

6. The system of claim 3 wherein the width of said opening is less than the width of said associated receiving groove.

7. The system of claim 4 wherein the width of said opening is less than the width of said associated receiving groove.

8. The system of claim 2 wherein each said edge having at least one said tongue has at least two said tongues longitudinally spaced from each other and wherein each said adjacent panel includes a corresponding opening for each said tongue.

9. The system of claim 2 wherein each said locking member is flush with said first surface when in engagement with a tongue.

10. The system of claim 2 wherein each said locking member is flush with the sides of said receiving groove when in engagement with a tongue.

11. A storage container adapted for ready assembly and disassembly and comprising:

a series of panels each of which includes tongues or grooves along at least two edges thereof;

each said tongued panel comprising a first sheet section having an edge flange therearound, and at least one tongue disposed longitudinally of and extending outwardly from at least two associated said edges;

each said grooved panel comprising a second sheet section having an edge flange therearound and having associated with at least two edges thereof and spaced from said edges a support channel and a receiving channel, said channels arranged in back to back configuration and interconnected by at least one opening through said sheet section;

and wherein each said tongue of a tongued panel is adapted for insertion through a corresponding said opening of an adjacent grooved panel into an associated receiving channel, and each said associated edge of a tongued panel is adapted for insertion into a corresponding said support channel;

said system further comprising at least one locking member slidable in each said receiving channel and for slidably engaging and locking each said tongue in position when said tongue is inserted through a corresponding opening into an associated receiving channel.

12. A component system for constructing storage containers adapted for ready assembly and disassembly, said system comprising:

a series of panels at least some of which include first and second congruent surfaces joined by corresponding edges, at least two said edges of each said panel having associated therewith integral joining means;

said joining means comprising either (1) at least one tongue disposed longitudinally of and extending outwardly of at least one said associated edge; or (ii) a receiving groove in said first surface spaced from said associated edge, and an opening in said second surface communicating with said receiving groove; and wherein said each tongue of one panel is adapted for insertion through a corresponding said opening in an adjacent panel into an associated said receiving groove; and at least one locking member slidable in each said receiving groove for slidably engaging and locking each said tongue in position when said tongue is inserted through a corresponding said opening into an associated receiving groove.

* * * * *